US009257747B2

(12) United States Patent
Flores-Cuadras

(10) Patent No.: US 9,257,747 B2
(45) Date of Patent: Feb. 9, 2016

(54) VIVALDI-MONOPOLE ANTENNA

(71) Applicant: Javier Ruben Flores-Cuadras, Tijuana (MX)

(72) Inventor: Javier Ruben Flores-Cuadras, Tijuana (MX)

(73) Assignee: TAOGLAS GROUP HOLDINGS LIMITED, Enniscorthy, Co. Wexford (IE)

( * ) Notice: Subject to any disclaimer, the term of this patent is extended or adjusted under 35 U.S.C. 154(b) by 0 days.

(21) Appl. No.: 14/093,413

(22) Filed: Nov. 29, 2013

(65) Prior Publication Data

US 2014/0306854 A1 Oct. 16, 2014

Related U.S. Application Data

(63) Continuation-in-part of application No. 13/932,150, filed on Jul. 1, 2013, now abandoned.

(60) Provisional application No. 61/666,795, filed on Jun. 30, 2012.

(51) Int. Cl.

| | |
|---|---|
| ***H01Q 13/10*** | (2006.01) |
| ***H01Q 5/00*** | (2015.01) |
| ***H01Q 13/08*** | (2006.01) |
| ***H01Q 5/307*** | (2015.01) |
| ***H01Q 5/40*** | (2015.01) |

(52) U.S. Cl.
CPC ..... *H01Q 5/0027* (2013.01); *H01Q 5/307* (2015.01); *H01Q 5/40* (2015.01); *H01Q 13/085* (2013.01)

(58) Field of Classification Search
CPC .. H01Q 5/0034; H01Q 13/106; H01Q 5/0027
See application file for complete search history.

(56) References Cited

U.S. PATENT DOCUMENTS

| | | | | |
|---|---|---|---|---|
| 5,508,159 | A * | 4/1996 | Okuyama et al. | 430/567 |
| 6,191,750 | B1 * | 2/2001 | Bonebright | 343/767 |
| 6,900,770 | B2 * | 5/2005 | Apostolos | 343/725 |
| 7,129,584 | B2 * | 10/2006 | Lee | 257/778 |
| 7,460,077 | B2 * | 12/2008 | Hemmi et al. | 343/725 |
| 2006/0208954 | A1 * | 9/2006 | Han et al. | 343/767 |
| 2007/0126648 | A1 * | 6/2007 | Svensson et al. | 343/767 |
| 2007/0171140 | A1 * | 7/2007 | Minard et al. | 343/770 |
| 2009/0207072 | A1 * | 8/2009 | Hong et al. | 342/194 |
| 2009/0262036 | A1 * | 10/2009 | Thevenard et al. | 343/767 |
| 2013/0009834 | A1 * | 1/2013 | Hefele et al. | 343/770 |

* cited by examiner

*Primary Examiner* — Trinh Dinh
(74) *Attorney, Agent, or Firm* — Coastal Patent Law Group, P.C.

(57) ABSTRACT

A Vivaldi-Monopole antenna is a small form ultra-wideband antenna configured for low frequency operation in modern wireless devices. The Vivaldi-Monopole antenna comprises a tapered-slot element and a monopole element, wherein current modes of each element are combined to yield a functional and small form ultra-wideband antenna configured for low frequency resonances.

13 Claims, 5 Drawing Sheets

Fo=700 MHz

Fo=3000 MHz

VIVALDI-MONOPOLE ANTENNA

CROSS-REFERENCE TO RELATED APPLICATIONS

This application is a continuation in part (CIP) of U.S. Ser. No. 13/932,150, filed Jul. 1, 2013, and titled "VIVALDI-MONOPOLE ANTENNA";

which claims benefit of priority with U.S. Provisional Ser. No. 61/666,795, filed Jun. 30, 2012;

the contents of each of which are hereby incorporated by reference.

BACKGROUND

1. Field of the Invention

This invention relates to antennas for wireless communications; and more particularly, to a novel antenna structure herein termed a "Vivaldi-Monopole Antenna" that is configured for ultra-wideband operation.

2. Description of the Related Art

Those having skill in the art will appreciate the difficulty in forming an antenna that exhibits stable radiation performance across the ultra-wide bandwidth, especially where low frequency communications bands are desired.

For this reason, there is a continued need for ultra-wideband antennas having relatively small form factor for integration with a variety of portable wireless devices.

In the prior art, an antenna structure known as a "Vivaldi Antenna" is described as having a tapered notch configured to achieve ultra-wide band resonances. Vivaldi antennas are generally understood by those in the art; however, further review of such antennas can be accomplished with an internet search. Accordingly, a detailed review of Vivaldi antennas is not provided herein.

In the Vivaldi antenna, current distribution tends to travel at the edges of the tapered element. Because of this, low frequency bands are not achievable with the standard Vivaldi tapered slot unless a very large element is provided. However, because large antennas are not desirable with modern electronics, a large conventional Vivaldi antenna is not a suitable solution for applications where ultra-wideband and low frequency characteristics are desired.

There is a need for ultra-wideband antennas capable of low frequency resonances for use in modern communications devices.

SUMMARY

A modified Vivaldi antenna, hereinafter referred to as a "Vivaldi-Monopole Antenna" is described.

The Vivaldi-Monopole antenna is a novel antenna configuration comprising a tapered slot portion and a monopole element for achieving ultra-wideband and low frequency resonance.

BRIEF DESCRIPTION OF THE DRAWINGS

The Vivaldi-Monopole antenna is herein described with reference to the appended drawings, wherein.

DETAILED DESCRIPTION OF EMBODIMENTS

A novel antenna structure, referred to herein as a "Vivaldi-Monopole Antenna", is suggested for wireless communication across an ultra-wide bandwidth, including the lower cellular bands at 700 MHz, 850 MHz, and 900 MHz, along with higher frequencies in the wireless industry's electromagnetic spectrum.

The Vivaldi-Monopole antenna comprises a Vivaldi-type tapered slot element and a monopole element. By combining the current distribution modes of the tapered slot element with the monopole element as illustrated herein, an ultra-wideband antenna configured for operation at low band cellular frequencies (ex: 700 MHz-900 MHz) is achieved.

Figure 1A:
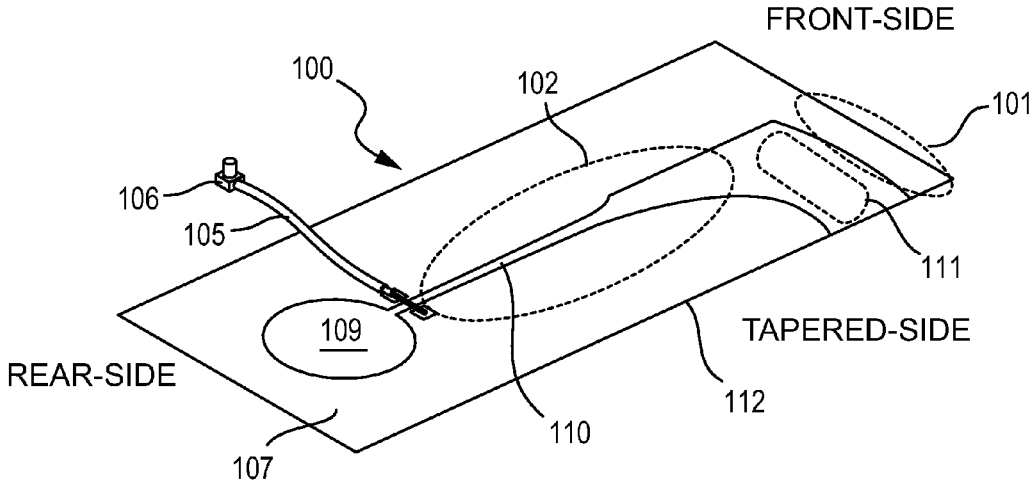
FIGS. 1(A-B) show a Vivaldi-Monopole antenna in accordance with an embodiment.
Figure 1B:
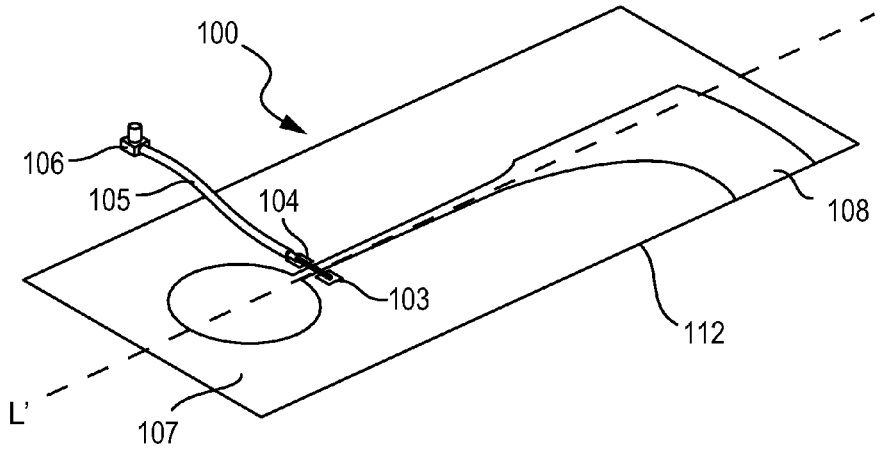

Now turning to the drawings, FIGS. 1(A-B) show a Vivaldi-Monopole antenna 100 in accordance with an embodiment. The Vivaldi-Monopole antenna 100 comprises a thin rectangular conductor volume 107 extending along a longitudinal axis (L') from a rear edge to a front edge. The conductor 107 further comprises an aperture 109 having a center thereof disposed near the longitudinal axis, and a first slot 110 extending from the aperture toward a center of the rectangular conductor 107. At least a portion of the first slot 110 is tapered toward a side edge of the conductor, herein termed the "tapered side" 112. The first slot 110 forms a tapered slot element 102 that is configured for one or more high frequency resonances. The conductor further comprises a monopole element 101 disposed along the front edge, wherein the monopole element comprises a length of conductor extending from the longitudinal axis toward the tapered side along at least a portion of the front edge. The monopole element 101 is separated from first slot 110 by a lateral slot 111 therebetween, wherein the lateral slot is oriented perpendicular with respect to the longitudinal axis. A signal feed pad 103 and a ground feed pad 104, respectively, are disposed across the first slot 110 at a point adjacent to the aperture 109.

A flexible mini-coaxial cable 105 is shown, wherein the mini coaxial cable comprises a mini-RF connector 106 at a terminal end thereof, and a conductor wire being soldered to each of the ground 104 and signal feed pads 103, respectively.

The conductor can be fabricated on a substrate using any electroplating, electro-depositing, printing, or other method known in the art. Moreover, the substrate can be a dielectric substrate.

In various applications as illustrated herein, it is beneficial to form the antenna on a flexible substrate. Flexible substrates include Kapton™ polyimide substrate and other similar substrates known in the art.

Figure 2:
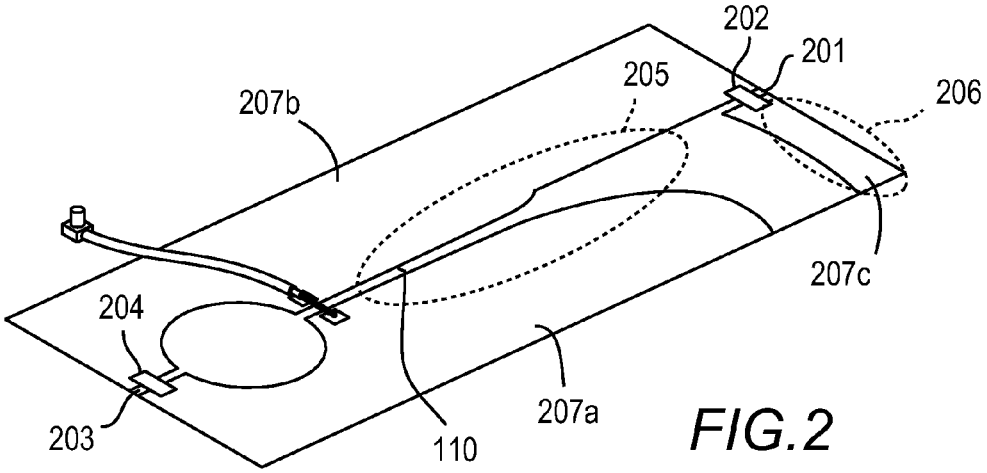
FIG. 2 shows a Vivaldi-Monopole antenna in accordance with another embodiment.

FIG. 2 shows a Vivaldi-Monopole antenna in accordance with another embodiment. The antenna is similar to the embodiment described above. However, the antenna in this embodiment comprises three conductor portions 207*a*; 207*b*; and 207*c*, respectively. The first conductor portion 207*a* is separated from the second conductor portion 207*b* by the first slot 110 of the tapered slot element 205 extending therebetween, and by a first gap 203 extending therebetween at the rear edge. The third conductor portion 207*c* forming the monopole element 206, is separated from the second conductor portion 207*b* by a second gap 201 extending therebetween at the front edge.

In this form, the Vivaldi-Monopole antenna can be tailored to various applications by coupling a component between two adjacent conductor portions. For example, a low pass filter 204 can be coupled between the first conductor portion 207*a* and the second conductor portion 207*b* across the first gap 203. Moreover, a high pass filter 202 can be coupled between the second conductor portion 207*b* and the third conductor portion 207*c* across the second gap 201. In this regard, the respective conductor portions can be filtered for configuring the Vivaldi-Monopole antenna for various resonances depending on the application. If filtering is not desired, a conductor, resistor or other passive component may be coupled between two adjacent portions.

Figure 3:
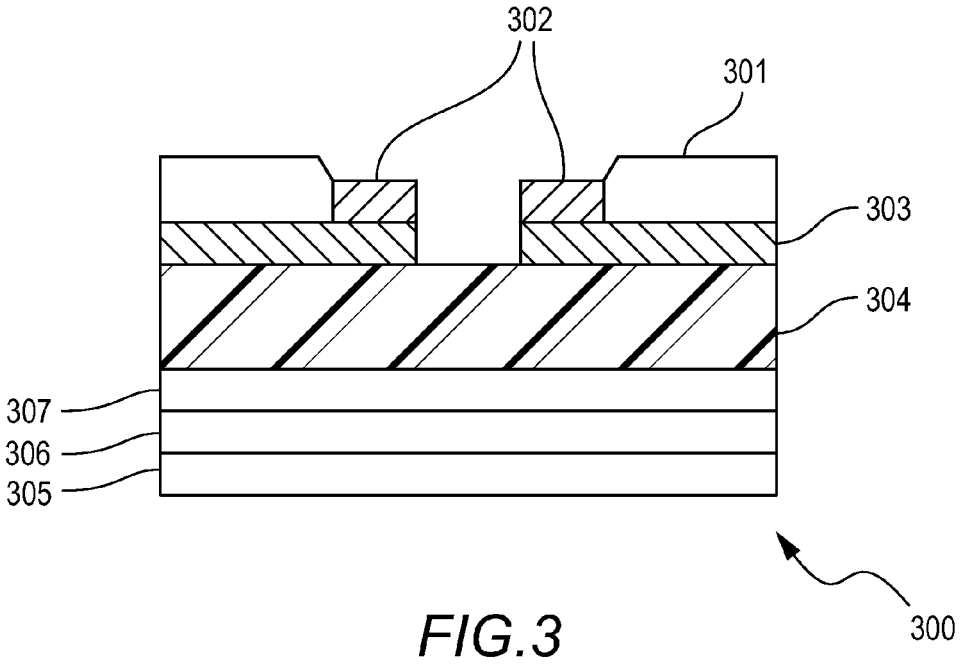
FIG. 3 shows a sectional view of the Vivaldi-Monopole antenna in accordance with an embodiment.

FIG. 3 shows a sectional view 300 of the Vivaldi-Monopole antenna in accordance with an embodiment. The antenna comprises a substrate layer 304 having a top surface and a bottom surface thereof. A metallized layer 303, preferably copper, tin, gold, or other conductor metal, is disposed about the top surface of the substrate. A layer of solder mask 301 is applied to the metallized layer in a desirable pattern as would be determined by those having skill in the art. An optional conductive layer 302, for example, tin, can be formed on a portion of the metallized layer 303 to form one or more solder pads. A bottom solder mask layer 307 is formed on the bottom surface of the substrate. An adhesive layer 306 is formed below the bottom solder mask layer. A removable liner 305 is attached to the adhesive layer.

Although the Vivaldi-Monopole antenna can be fabricated in a rigid form, it is preferable to form the antenna on a flexible substrate for certain applications.

Figure 4A:
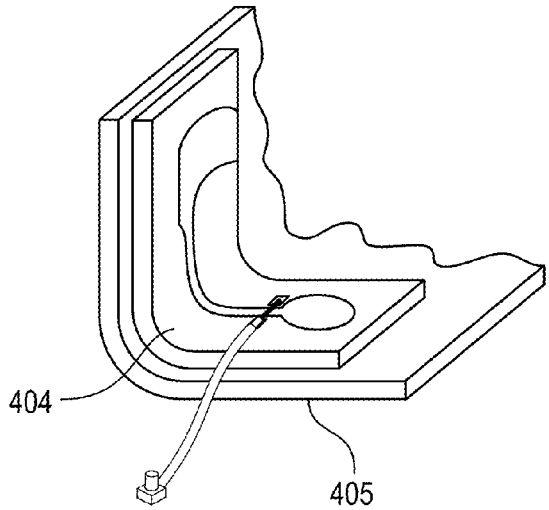
FIG. 4A shows a flexible Vivaldi-Monopole antenna fixed at a ninety degree bend within a device housing.

For example, FIG. 4A shows a device housing 405 having an orthogonal bend (or right-angle) corner. In order to attach the antenna 404 at the corner, it is beneficial to form the antenna on a flexible substrate.

Figure 4B:
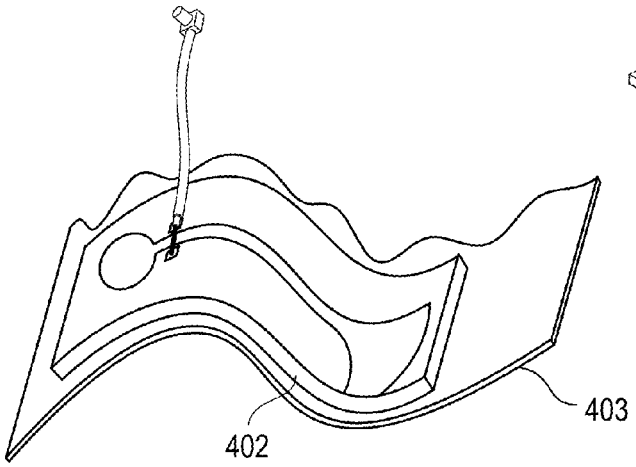
FIG. 4B shows a flexible Vivaldi-Monopole antenna fixed about a curved surface of a device housing.

Similarly, FIG. 4B illustrates a wavy device housing. A flexible antenna 402 can conform to the wavy housing 403.

Figure 4C:
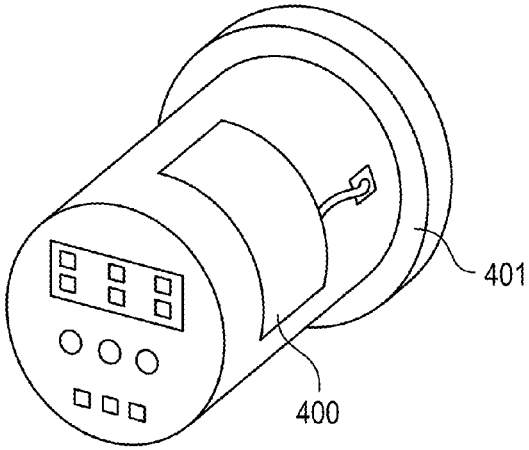
FIG. 4C shows a flexible Vivaldi-Monopole antenna fixed within a round device housing such as, for example, a utility meter.

An example of an application suitable for a flexible Vivaldi-Monopole antenna is a utility meter, such as an electric or water utility meter. FIG. 4C illustrates the flexible antenna 400 attached to a round utility meter housing 401.

Figure 5:
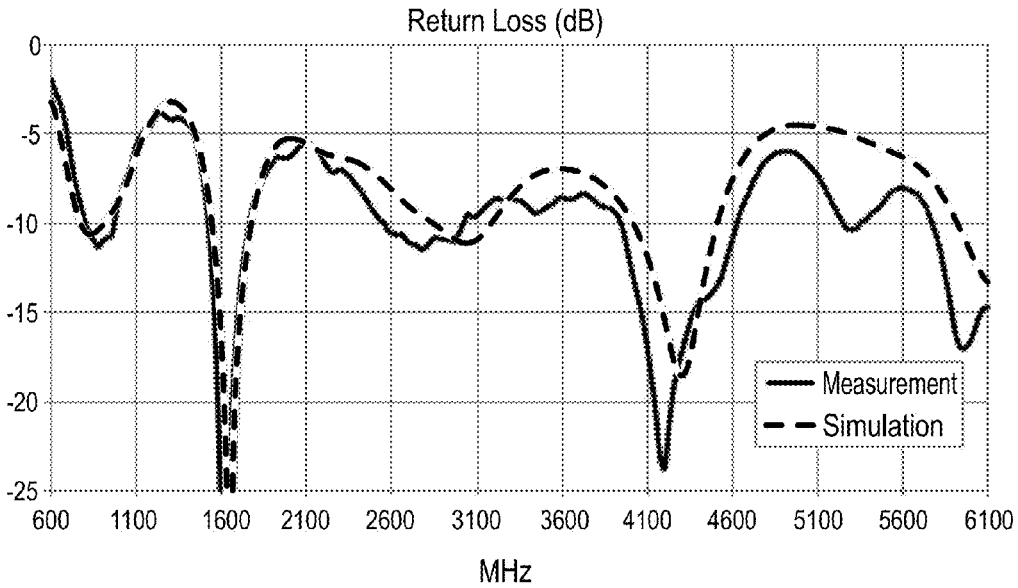
FIG. 5 shows a plot of return loss associated with the Vivaldi-Monopole antenna of FIG. 1.

FIG. 5 shows a plot of return loss (dB) of the Vivaldi-Monopole antenna of FIG. 1 over a wideband spectrum. Both a simulated plot and a measured plot are illustrated. As shown in FIG. 5, the Vivaldi-Monopole antenna provides low-band resonances between 700 MHz and 900 MHz, and additional high-band resonances between 1600 MHz and 6000 MHz.

Figure 6:
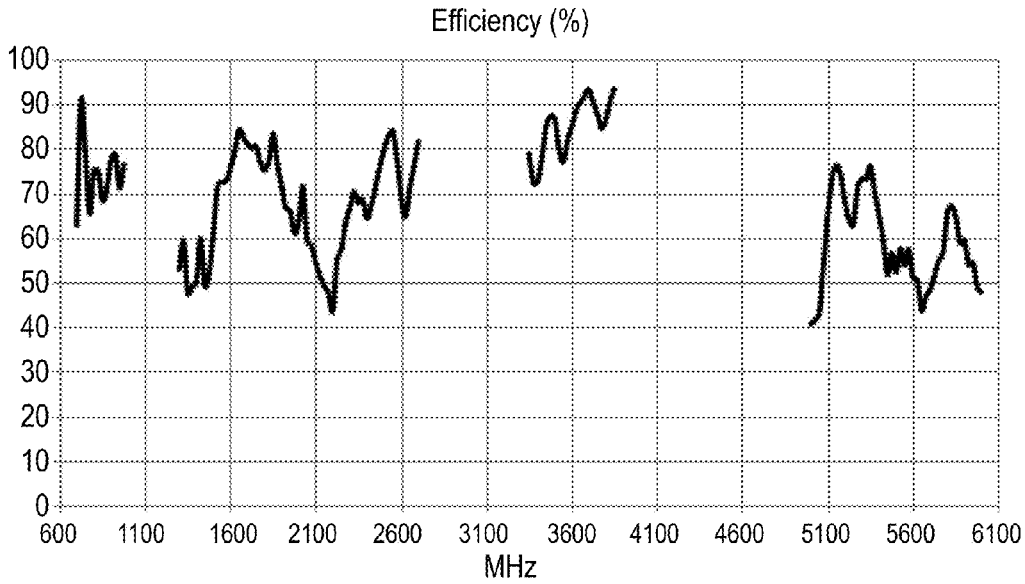
FIG. 6 shows a plot of efficiency associated with the Vivaldi-Monopole antenna of FIG. 1.

FIG. 6 shows a plot of efficiency (%) of the Vivaldi-Monopole antenna of FIG. 1 over a wideband spectrum.

Figure 7:
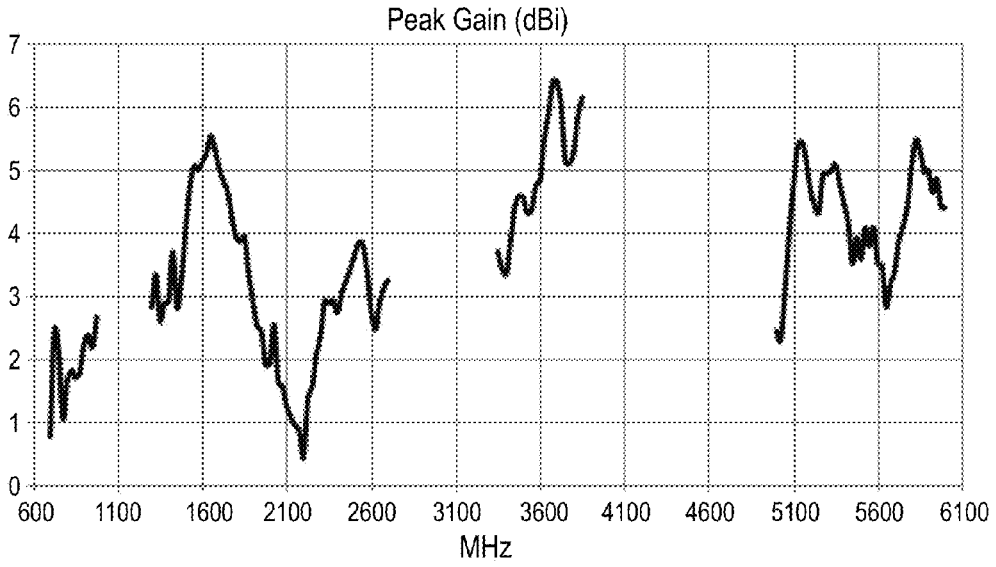
FIG. 7 shows a plot of peak gain associated with the Vivaldi-Monopole antenna of FIG. 1.

FIG. 7 shows a plot of peak gain (dB) of the Vivaldi-Monopole antenna of FIG. 1 over a wideband spectrum.

Figure 8A:
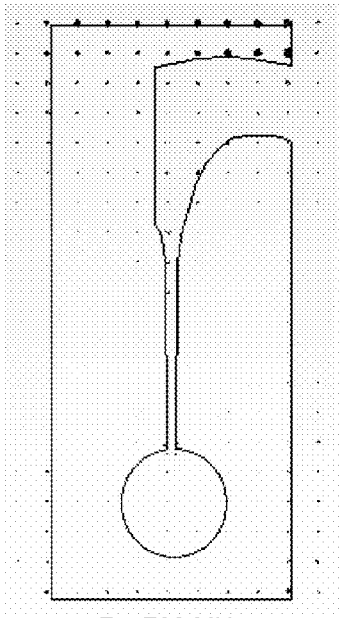
FIG. 8A shows a current distribution about the Vivaldi-Monopole antenna of FIG. 1 at 700 MHz.

FIG. 8A illustrates the current distribution of the Vivaldi-Monopole antenna according to the embodiment of FIG. 1 for a first working frequency at 700 MHz.

Figure 8B:
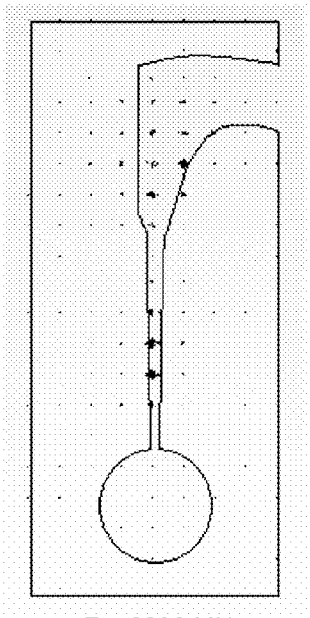
FIG. 8B shows a current distribution about the Vivaldi-Monopole antenna of FIG. 1 at 3000 MHz.

FIG. 8B illustrates the current distribution of the Vivaldi-Monopole antenna according to the embodiment of FIG. 1 for a first working frequency at 3000 MHz.

Although the above examples illustrate particular embodiments, it should be understood by those having skill in the art that a variety of alternative embodiments can be practiced with little experimentation or deviation from these examples. Accordingly, the spirit and scope of the invention shall not be limited to these descriptions, which are provided as illustrative examples of the various features and embodiments only, but rather, the scope shall be set forth by the appended claims.

What is claimed is:

1. An antenna, comprising:

a rectangular conductor volume extending along a longitudinal axis from a rear-side edge to a front-side edge;

said conductor volume further comprising:

an aperture disposed adjacent to the rear-side edge, the aperture having a center thereof disposed along the longitudinal axis;

a first slot extending from the aperture toward a center of the rectangular conductor volume, the first slot dividing the conductor volume into a first conductor portion disposed on a first side of the first slot and a second conductor portion disposed on a second side of the first slot opposite of the first side, at least the first conductor portion being tapered toward a side-edge of the conductor volume;

the first slot defining a tapered slot element; and a third conductor portion extending about at least a portion of the front-side edge from the longitudinal axis toward the side edge, the third conductor portion defining a monopole element.

2. The antenna of claim 1, wherein said antenna is formed on a dielectric substrate.

3. The antenna of claim 2, wherein said dielectric substrate is a flexible substrate.

4. The antenna of claim 3, wherein said flexible substrate comprises a kapton polyimide substrate.

5. The antenna of claim 1, wherein said tapered slot element is configured for one or more high-band resonances, said high-band resonances within the range of 1600 MHz and 6000 MHz.

6. The antenna of claim 1, wherein said monopole element is configured for one or more low-band resonances, said low-band resonances within the range of 700 MHz and 900 MHz.

7. The antenna of claim 1, wherein said first conductor portion is further separated form said second conductor portion by a first gap extending from the aperture to the rear-side edge of the conductor volume.

8. The antenna of claim 7, wherein said first conductor portion is coupled to said second conductor portion by a low pass filter coupled therebetween.

9. The antenna of claim 7, wherein said first conductor portion is coupled to said second conductor portion by a resistor coupled therebetween.

10. The antenna of claim 7, wherein said second conductor portion is separated from said third conductor portion by a second gap.

11. The antenna of claim 10, wherein said second conductor portion is coupled to said third conductor portion by a high pass filter coupled therebetween.

12. The antenna of claim 10, wherein said second conductor portion is coupled to said third conductor portion by a resistor coupled therebetween.

13. The antenna of claim 1, wherein said monopole element is separated from said tapered slot element by a lateral slot; wherein said lateral slot is oriented perpendicular to the longitudinal axis.

* * * * *